United States Patent [19]

Wallner et al.

[11] 4,453,794

[45] Jun. 12, 1984

[54] FUSE HOLDER, ESPECIALLY FUSE HOLDER FOR ELECTRICAL DEVICES

[75] Inventors: Peter Wallner, Kriens; Peter Hollenstein, Lucerne, both of Switzerland

[73] Assignee: H. Schurter AG, Lucerne, Switzerland

[21] Appl. No.: 402,308

[22] Filed: Jul. 27, 1982

[30] Foreign Application Priority Data

Jan. 13, 1982 [CH] Switzerland ..... 178/82

[51] Int. Cl.[3] ..... H01R 13/68

[52] U.S. Cl. ..... 339/90 F; 339/147 R; 339/256 C

[58] Field of Search ..... 339/147 R, 90 F, 213 T, 339/256 C, 258 TC, 181 R, 181 C, 256 S, 258 RR; 337/187, 495, 201

[56] References Cited

U.S. PATENT DOCUMENTS

| | | | |
|---|---|---|---|
| 1,930,594 | 10/1933 | Marchand | 337/201 |
| 2,386,060 | 10/1945 | Powell | 337/187 |
| 3,236,974 | 2/1966 | Louden et al. | 337/195 |

FOREIGN PATENT DOCUMENTS

| | | | |
|---|---|---|---|
| 2348306 | 3/1974 | Fed. Rep. of Germany | 339/256 C |

*Primary Examiner*—Eugene F. Desmond
*Attorney, Agent, or Firm*—Werner W. Kleeman

[57] ABSTRACT

The fuse holder contains a socket and a head member which is loosely seated in the socket by means of a quick release closure, such as a bayonet connection and can be removed along the lengthwise axis of the fuse holder. Seated in the socket at its closed end is a base contact containing a connection tab or flag and a lateral or side contact having a connection tab or flag. At the head member, the closed end of which is located at the open end of the socket, there is provided a substantially U-shaped connection conductor which fixedly claws into the head member by means of retaining or holding flaps provided at a web portion of the U-shaped connection conductor. The legs of the U-shaped connection conductor extend from the web portion of the U-shaped connection conductor at an inclination inwardly at a predetermined location towards the lengthwise axis of the fuse holder to an internal contact location for a first cap member of the fuse insert or fuse. A second cap member of the fuse insert is pressed by an axial compression or pressure spring against the base contact. The legs of the U-shaped connection conductor then again extend outwardly at an inclination up to an external contact location where they produce a frictional connection with the lateral or side contact. With a most simple construction of the fuse holder there is obtained a mechanically and electrically faultless solution, which not only possesses an extremely good tolerance range, but additionally allows converting the fuse holder so that it can handle fuse inserts of other dimensions by simply exchanging the connection conductor and the compression or pressure spring.

12 Claims, 4 Drawing Figures

FUSE HOLDER, ESPECIALLY FUSE HOLDER FOR ELECTRICAL DEVICES

BACKGROUND OF THE INVENTION

The present invention relates to a new and improved construction of a fuse holder, especially a fuse holder for various electrical devices.

Generally speaking, the fuse holder of the present development is of the type comprising a socket formed of an electrically insulating material and extending along a predetermined axis and open at one end thereof. At the open end of the socket there is inserted a substantially tubular-shaped head member formed of an electrically insulating material. This head member is closed at its outer end and is open at its inner end and can be removably inserted into the socket along the aforementioned axis. In the socket there are attached a base or foot contact and a side or lateral contact possessing outwardly directed connection portions. In the head member there are attached a connection conductor and an axially effective pressure or compression spring. The connection conductor is releaseably electrically conductively connected with the lateral or side contact. The connection conductor and the compression spring are secured in the head member in such a manner that a fuse insert or fuse located in its work position in the fuse holder makes an electrically conductive contact at its one electrically conductive end with the connection conductor and under the action of the compression spring makes an electrically conductive contact at its other electrically conductive end with the base or foot contact.

With such type of fuse holders, depending upon the design thereof, there can arise a so-called push-button effect which can result in loose or wobble contacts. To avoid this undesired phenomenon it was heretofore necessary to provide complicated measures or facilities by means of which there were optimized the fitting accuracy and material properties.

A further problem existing with such fuse holders resides in retaining the fuse insert inserted into the head member in such a good manner therein that upon removal of the head member the fuse insert does not remain in the socket from where it only can be again removed by performing dangerous manipulations.

In order to preclude this from happening it was necessary to heretofore provide specially designed clamping springs which had to be additionally fabricated and assembled, resulting in a considerable expenditure in manufacturing these fuse holders. If such special clamping springs were not used then it was necessary to work with extremely close fits, rendering it impossible to attain the desired tolerance flexibility or range.

SUMMARY OF THE INVENTION

Therefore, with the foregoing in mind it is a primary object of the present invention to provide a new and improved construction of a fuse holder which is not associated with the aforementioned limitations and drawbacks of the prior art constructions.

Another and more specific object of the present invention aims at providing an economically advantageously fabricatable yet still mechanically and electrically high-grade fuse holder which does not exhibit the aforementioned drawbacks, and furthermore, provides an improved tolerance range or capability.

Still a further significant object of the present invention is directed to a new and improved construction of fuse holder, especially a fuse holder for various types of electrical devices, which allows for adaptation thereof in a most simple fashion so that the same can be reliably and effectively used with different size fuse inserts or fuses.

Now in order to implement these and still further objects of the invention, which will become more readily apparent as the description proceeds, the fuse holder of the present development is manifested by the features that, the connection conductor which is fabricated from a spring or resilient metal is constructed as a substantially U-shaped bracket member having a web portion extending transversely with respect to the lengthwise axis of the fuse holder and leg portions or members protruding from the web portion. Each leg member of the U-shaped web portion extends inwardly at an inclination with respect to the lengthwise axis of the fuse holder towards an inner contact location for the associated end of the fuse insert and from that location extends a frictional connection outwardly towards an outer contact location forming with the side or lateral contact at the inner side thereof.

The head member of this fuse holder can be selectively connected with the socket either by means of, for instance, a bayonet connection, something desired for certain fields of application, but also by means of a threaded connection, without there arising the undesirable push-button effect. Also, there are here precluded the errors which occur when using a threaded connection in terms of a faulty or inadequate contact pressure with the lateral contact and connection conductor flushly pressed against one another.

Both the base contact and also the lateral or side contact of the socket can be designed as rigid contacts, and they can be rationally and durably fabricated and installed, since the spring or resilient properties can be completely assumed by the connection conductor and the compression or pressure spring. The compression spring can produce the required contact pressure for the fuse insert with respect to the base or foot contact, whereas the connection conductor, by virtue of the opposed action of its inner contact location with respect to its outer contact location, can produce a good contact pressure both at the lateral contact of the socket and also at the end of the fuse insert.

By virtue of the construction of the leg members of the U-shaped connection conductor so as to extend inwardly towards the lengthwise axis of the fuse holder, there is not only possible an extremely good retention of the fuse insert without the need to resort to any special holding spring, but additionally there is provided internally of the head member a great deal of play for providing a tolerance equalization or compensation. In fact this is possible to such an extent that there can be advantageously employed quite different sizes of fuse inserts or fuses if there is only then used a different connection conductor and/or a different compression spring while otherwise employing identical parts of the fuse holder. This renders the fuse holder of the present invention so universal in its application that, by simply exchanging the head member from, for instance, a standard sizse for the United States to, for instance, a standard size according to the German Industrial Standard, it is possible to easily and rapidly convert the fuse holder so that it can handle different size fuse inserts or fuses. This constitutes an enormous advantage for manufacturers of electrical devices or appliances, since it is now possible to install the fixedly mountable socket into the electrical devices or the like without having to take into account the nature of the fuse inserts or fuses which are intended to be used at a later point in time.

Additionally, the connection conductor can be constructed in a material-saving manner and still so as to possess a sufficient length as concerns its spring or resilient properties.

It is advantageous if the attachment of the connection conductor in the head member is accomplished by clamping the web portion of the U-shaped connection conductor, and thus, there preferably can be provided two retaining or holder flaps or tabs which laterally protrude between the leg portions or members members of the U-shaped connection conductor. These holder flaps, upon insertion of the connection conductor into the head member, act in a bending fashion opposite to the insertion direction as barb-like holders or retention elements and prevent the removal of the connection conductor. Because these flaps are located between the leg portions or members of the U-shaped connection conductor, the web portion thereof is desirably reinforced due to the bending of the flaps, so that it practically does not carry out any spring resilient action when the leg members are moved. This affords a clean separation or demarcation between the mechanical anchoring and the spring or resilient properties of the connection conductor, without there being necessary for this purpose an increased expenditure for the fuse holder.

Particularly with this demarcation of the tasks it is advantageous if the leg members are designed to be domed about the lengthwise axis of the fuse holder. Consequently, they can experience a certain dosed or controllable increase in their spring properties, and additionally, they require less space in radial direction within the head member. The last-mentioned feature is also compatible with the tolerance capability of the fuse holder, without the need to have to unnecessarily increase the thickness of the head member.

By virtue of the provision of the compression or pressure spring it is possible to control extremely well the tolerance capability of the fuse holder in the lengthwise direction, i.e. axially.

However, the aforementioned doming or arching of the leg members also improves the contact thereof with the related or associated end of the fuse insert, which is thus much better centered and held than between flat leg members of a U-shaped connection element.

Particularly when using relatively short fuse inserts or fuses there can be required an extremely close arrangement of the inner contact locations and the outer contact locations of the kleg members of the U-shaped connection conductor. Especially suitable for this purpose is an arrangement of those parts of the leg members forming such contact locations at the end region or ends of the leg members of the U-shaped connection conductor, wherein there are advantageously subdivided such ends of the leg members into a number of arms. As to these arms or arm members at least one of them is constructed as the inner arm of the inner contact and at least another of them is constructed as the outer arm of the outer contact. A preferred arrangement is constituted by a three-finger or three-prong design wherein the outer arm is arranged between two inner arms. This affords an exceptionally good holding of the fuse insert or fuse.

A simple and spatially small design of the fuse holder therefore can be economically fabricated. The head member and socket can be manufactured from a suitable plastics material, such as thermosetting or thermoplastic resins of known type, and the metal parts can be simply inserted and fixed in place. Also, the metal parts or components can be fabricated as simple mass produced articles, especially by punching, bending, embossing and the like.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
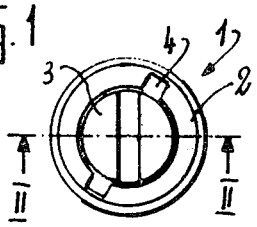
FIG. 1 is a top plan view of the end of a fuse holder containing the head member.
Figure 3:
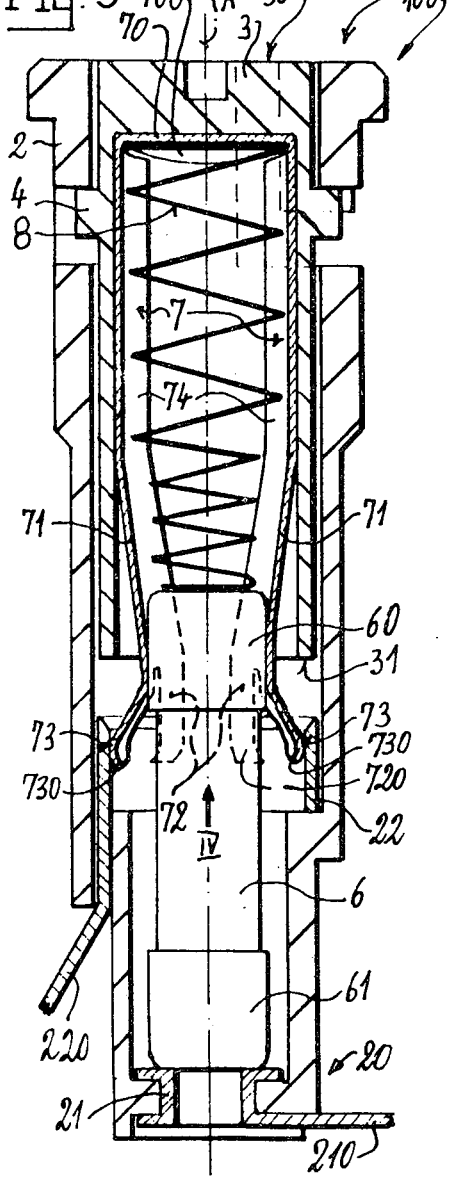
FIG. 3 illustrates a further embodiment of fuse holder depicted in the same sectional view as the arrangement of FIG. 2, with the exception that here there are depicted different constructions of the connection conductor, the compression spring and the fuse insert.
Figure 2:
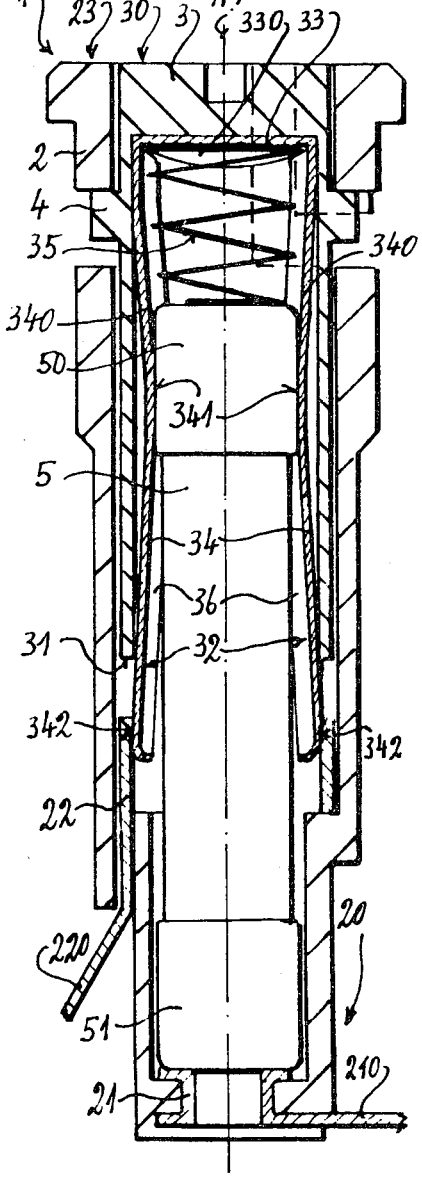
FIG. 2 is an enlarged axial sectional view of the fuse holder depicted in FIG. 1, taken substantially along the line II—II thereof.

Before describing the drawings in greater detail, it is here specifically mentioned that throughout FIGS. 1 to 4 the same parts have been generally designated by the same reference characters inasmuch as the differences between the two illustrated embodiments of fuse holders are essentially only as previously described. Both the fuse holder 1 of the embodiment of FIGS. 1 and 2 and the fuse holder 100 of the embodiment of FIGS. 3 and 4 each possess a socket or socket member 2 formed of a suitable electrically insulating plastics material and a head member 3 formed of a suitable electrically insulating plastics material. The socket 2 has opposed ends and is internally provided at its closed end 20 with a base or foot contact 21 which extends outwardly in the form of a connection or terminal 210. Furthermore, there is provided a side or lateral contact 22 which extends towards the side to form a connection or terminal 220. The sockets 2 of both of the embodiments of fuse holders respectively depicted in FIGS. 2 and 3 are exactly identical to one another.

At the other socket end 23 which is open, there is inserted the head member 3 and releasably connected by means of, for instance, a bayonet connection or closure 4 with the socket 2. Instead of using a quick release connection such as the bayonet connection 4 the socket 2 and the head member 3 also could be connected by screw or thread connection means, and thus, the connection 4 is to be conceptually considered to also constitute such thread or screw connection means. The head end 30 which is in alignment with the socket end 23 is, as shown, closed, whereas the other or opposite head end 31 of the head member 3 which is located within the socket 2 is open.

Thus, the head members 3 of the fuse holder constructions depicted in FIGS. 2 and 3, are identical as concerns their plastic parts and only differ from one another as concerns the so-called fittings or elements located therein.

In the embodiment of fuse holder depicted in FIG. 2 there is provided a connection conductor 32 which is constructed as a substantially U-shaped bracket member. This U-shaped connection conductor 32 has a web portion or U-web 33 which is clampingly retained by suitable holder or retaining tabs or flaps 330 in the head member 3, whereas the leg portions or members 34, also referred to as U-legs, extend approximately in the direction of the lengthwise axis A of the fuse holder towards the side or lateral contact 22. A first portion 340 of each of the leg members 34 extends at an inclination with respect to the fuse holder-lengthwise axis A upwardly up to the region of the inner contact locations 341, between which there is seated a first end cap or cap member 50 of the fuse 5, whereas a compression or pressure spring 35, due to its action upon this first member cap 50, presses a second end cap or cap member 51 against the base or foot contact 21.

Each leg portion or member 34 extends from the related inner contact location 341 to its outer contact location or area 342, where it forms a frictional connection with the side or lateral contact 22.

Consequently, it is possible, for instance, to produce a fuse holder which can be used with conventional fuse inserts of the type employed in electrical devices or appliances in the United States.

Figure 4:
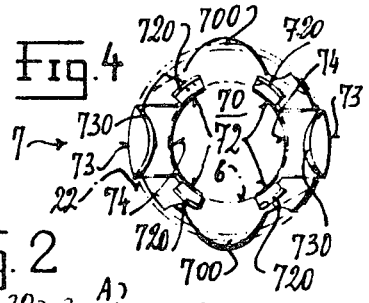
FIG. 4 is an end view of the connection conductor used in the arrangement of FIG. 3 and shown in its dismantled state prior to insertion into the fuse holder.

Now if it is intended to use, instead of the fuse insert or fuse 5 depicted in the embodiment of fuse holder shown in FIG. 2, a smaller fuse insert or fuse, for instance a European-type fuser insert 6 containing the end cap members or caps 60 and 61, then the socket 2 and the base contact 21 as well as the lateral or side contact 22, and even the head member 3, can be left unaltered in the modified arrangement of FIG. 3, whereas the connection conductor 32 of the embodiment of fuse holder of FIG. 2 would be replaced by a connection conductor 7 of the type shown in FIGS. 3 and 4. Also this connection conductor 7 is constituted by a substantialy U-shaped metal bracket whose web portion 70, also referred to as a U-web 70, is retained by the holdes or attachment tabs or flaps 700, whereas its leg portions or members 71, also referred to as the U-legs 71, initially extend parallel to the lengthwise axis A of the fuse holder 100, then however, extend inwardly towards the inner contact locations 72 from where they then extend outwardly towards the outer contact locations or area 73. There are provided the arm members or arms 720 and 730, apparent from the showing of FIG. 4, by means of which it is possible to arrange in closely neighboring relationship to one another the inner contact locations 72 and the outer contact locations 73, and nonetheless to positively retain the fuse insert or fuse 6. Here, the axial pressure is exerted by a compression or pressure spring 8 which, of course, is appreciably longer than the compression spring 35 used with the construction of fuse holder depicted in FIGS. 1 and 2.

As will be readily recognized by measuring the distances in the embodiments of FIGS. 2 and 3, it is not possible to contact by means of the cap member 51 or the cap member 61 of the fuse inserts 5 and 6, respectively, the related lateral or side contact 22 before the end 31 of the head member 3 is at least so close to the end 23 of the socket that the connection conductor 32 or 7, as the case may be, can still be contacted by the hand of the user. With practical embodiments corresponding to the actual size used in practice, it is not possible, with any of the usually employed test or checking fingers of the user, to insert such finger into the socket 2 when the head member 3 is removed, so that also here there is obtained an increased safety against undesirable contact of the internal structure of the fuse holder by the user.

Reference numeral 36 in the embodiment of FIGS. 1 and 2 and reference numeral 74 in the embodiment of FIGS. 3 and 4 indicates that the leg members or U-legs 34 and 71, respectively, are domed or arched about the lengthwise axis A of the fuse holder, and therefore, have increased spring or resilient properties. This arching or doming contributes to the optimization of the spatial dimensions of the fuse holder.

While there are shown and described present preferred embodiments of the invention, it is to be distinctly understood that the invention is not limited thereto, but may be otherwise variously embodied and practiced within the scope of the following claims. Accordingly,

What we claim is:

1. A fuse holder comprising:

a socket member extending along a predetermined lengthwise axis;

said socket member being formed of electrically insulating material and having an open end;

a substantially tubular-shaped head member removably inserted into said open end of said socket member along the lengthwise axis thereof;

said head member being closed at an outer end thereof and being open at an inner end thereof and being formed of electrically insulating material;

a base contact and a lateral contact containing outwardly directed connection portions secured in said socket member;

a connection conductor arranged in said head member and releaseably electrically conductively connected with the lateral contact;

an axially effective compression spring;

said connection conductor and said axially effective compression spring being secured in said head member such that a fuse insert, when located in a work position thereof in the fuse holder, electrically conductively bears at one electrically conductive end thereof at the connection conductor and under the action of said compression spring bears by means of a further electrically conductive end thereof at the base contact;

said connection conductor being formed from a spring metal and defining a substantially U-shaped bracket member having a web portion and leg members;

said web portion extending transversely with respect to the lengthwise axis of the socket member and said leg members protruding from said web portion; and each leg member extending at an inclination inwardly from the web portion towards an inner contact location for a related end of the fuse insert and from that location extending outwardly towards and frictionally engaging an outer contact area at the inner side of the lateral contact.

2. The fuse holder as defined in claim 1, wherein:

the leg members possess domed locations which are arched about the lengthwise axis of the socket member.

3. The fuse holder as defined in claim 1, wherein:

each leg member possesses a multi-arm; and said multi-arm end defining at least one inner arm containing an inner contact and at least ne outer arm containing an outer contact.

4. The fuse holder as defined in claim 1, wherein:

said head member is exchangeable so as to adapt the fuse holder to handle different sizes of fuse inserts;

said head member being accommodated to the size of the used fuse insert and being equipped with said connection conductor and said compression spring and being exchangeable for a similar type electrically insulated head member which is accommodated to a different size of fuse insert and containing a different connection conductor and a different compression spring.

5. The fuse holder as defined in claim 1, wherein:

said fuse holder is structured with a diameter to prevent undesired contact with the interior thereof after removal of said head member from said socket member.

6. The fuse holder as defined in claim 1, further including:

bayonet connection means for form-lockingly releasably connecting the head member with the socket member.

7. The fuse holder as defined in claim 1, further including:

thread means for releasably connecting the head member with the socket member.

8. The fuse holder as defined in claim 1, wherein:

said socket member and said head member are lengthwise structured such that said connection conductor is inaccessible for outside contact when said fuse insert held by said connection conductor is in electrically conductive connection to said lateral contact.

9. The fuse holder as defined in claim 1, further including:

means for clampingly seating said web portion in the head member.

10. The fuse holder as defined in claim 9, wherein:

said clampingly seating means comprises laterally protruding clamping flaps provided for said web portion between the leg members; and said clamping flaps, upon insertion of the connection conductor into the head member, elastically engaging at the head member in the form of barb-like portions bent opposite to the insertion direction of the connection conductor.

11. A fuse holder comprising:

a socket member extending along a predetermined lengthwise axis;

said socket member being formed of electrically insulating material and having an open end;

a substantially tubular-shaped head member removably inserted into said open end of said socket member along the lengthwise axis thereof;

said head member being closed at an outer end thereof and being open at an inner end thereof and being formed of electrically insulating material;

a base contact and a lateral contact containing outwardly directed connection portions secured in said socket member;

a connection conductor arranged in said head member and releasably electrically conductively connected with the lateral contact;

an axially effective compression spring;

said connection conductor and said axially effective compression spring being secured in said head member such that a fuse insert, when located in a work position thereof in the fuse holder, electrically conductively bears at one electrically conductive end thereof at the connection conductor and under the action of said compression spring bears by means of a further electrically conductive end thereof at the base contact;

said connection conductor being formed from a spring metal and defining a substantially U-shaped bracket member having a web portion and leg members;

said web portion extending transversely with respect to the lengthwise axis of the socket member and said leg members protruding from said web portion;

each leg member exending at an inclination inwardly from the web portion towards an inner contact location for a related end of the fuse insert and from that location extending outwardly towards an outer contact location where it forms a frictional connection with the lateral contact at the inner side thereof;

an intermediate outer arm and two inner arms provided at an end region of each leg member; and said two inner arms being arranged at both sides of the outer arm.

12. A fuse holder comprising:

a socket member extending along a predetermined lengthwise axis;

said socket member being formed of electrically insulating material and having an open end;

a substantially tubular-shaped head member removably inserted into said open end of said socket member along the lengthwise axis thereof;

said head member being closed at an outer end thereof and being open at an inner end thereof and being formed of electrically insulating material;

a base contact and a lateral contact containing outwardly directed connection portions secured in said socket member;

a connection conductor arranged in said head member and releasably electrically conductively connected with the lateral contact;

an axially effective spring;

said connection conductor and said axially effective spring being secured in said head member such that a fuse insert, when located in a work position thereof in the fuse holder, electrically conductively bears at one electrically conductive end thereof at the connection conductor and under the action of said axially effective spring bears by means of a further electrically conductive end thereof at the base contact;

said connection conductor being formed from a resilient electrically conductive material and defining a substantially U-shaped bracket member having a web portion and leg members;

said web portion extending transversely with respect to the lengthwise axis of the socket member and said leg members protruding from said web portion;

means for clampingly seating said web portion in the head member; and each leg member extending at an inclination inwardly from the web portion towards an inner contact area for a related end of the fuse insert where it makes direct contact with said related end of the fuse insert and from that inner contact area extending outwardly towards and frictionally engaging an outer contact area at the inner side of the lateral contact.

* * * * *